United States Patent [19]

Mankoff et al.

[11] 3,935,651

[45] Feb. 3, 1976

[54] VOCABULARY PLAYING CARDS

[76] Inventors: Robert T. Mankoff; Marcy Mankoff, both of 73-11 Bell Blvd., Bayside, N.Y. 11364

[22] Filed: June 10, 1975

[21] Appl. No.: 585,482

[52] U.S. Cl. ..... 35/71; 273/152 R

[51] Int. Cl.[2] ..... A63H 33/04

[58] Field of Search ..... 35/35 J, 69, 70, 71; 273/152 R, 152.41, 152.5, 152.6, 152.7 R, 152.7 A

[56] References Cited

UNITED STATES PATENTS

| | | | |
|---|---|---|---|
| 2,583,494 | 1/1952 | Rilling | 35/71 |
| 3,678,602 | 7/1972 | Alam | 35/35 J |

FOREIGN PATENTS OR APPLICATIONS

| | | | |
|---|---|---|---|
| 712,039 | 6/1965 | Canada | 35/69 |

*Primary Examiner*—Harland S. Skogquist

[57] ABSTRACT

A deck of vocabulary building playing cards similar to a standard deck of playing cards having suit designations thereon, but including a vocabulary word on each card together with a plurality of definition words, only one of which is the correct definition of the vocabulary word. Each definition word includes a value denomination. The value denomination of each card corresponds to that of the correct definition of the vocabulary word on that card. The deck is adaptable to any standard card game after the value denominations of the cards have been identified by selection of the correct definitions of the vocabulary words.

6 Claims, 5 Drawing Figures

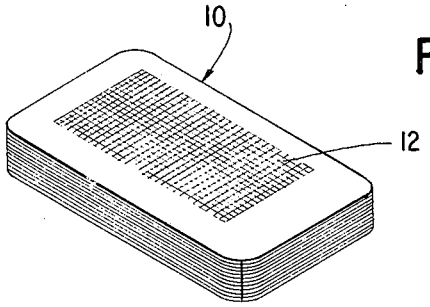
Fig. 1
Fig. 2
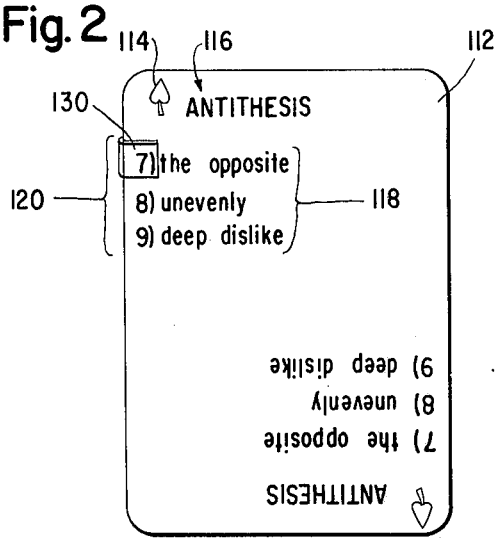
Fig. 3
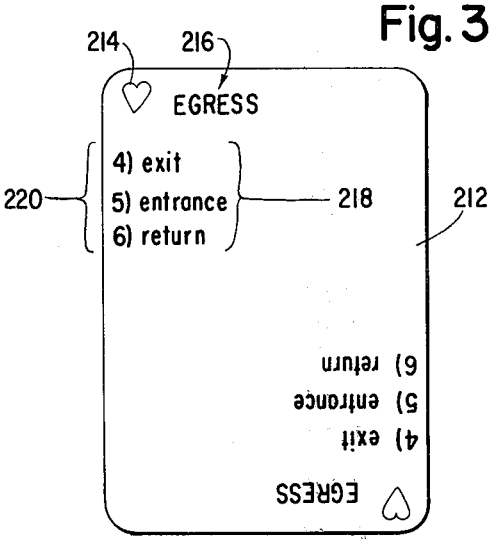
Fig. 4
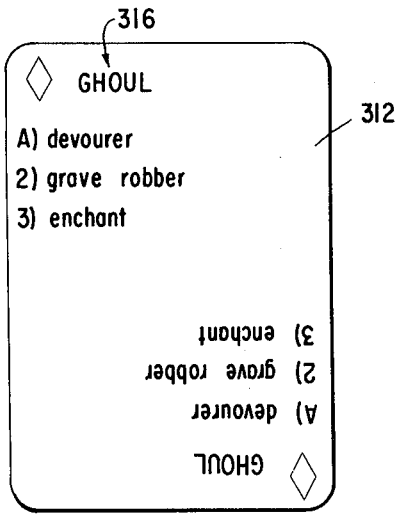
Fig. 5
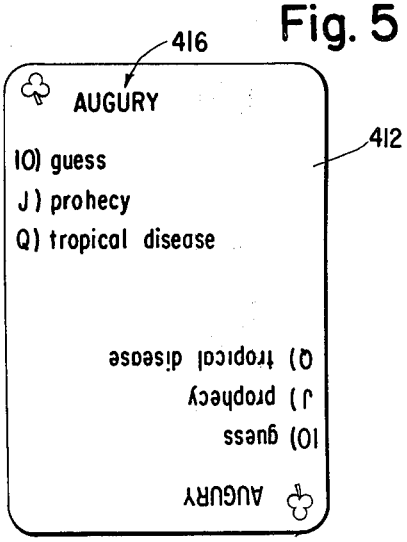

VOCABULARY PLAYING CARDS

BACKGROUND OF THE INVENTION

This invention relates generally to card games and more particularly to a novel deck of vocabulary building playing cards requiring the determination of the definition of certain vocabulary words for use of the deck in standard card games.

The teaching of vocabulary by conventional methods has always been somewhat of a problem. Generally those students who need the instruction the most are those who find it uninteresting and unappealing. To increase the interest and attention span of such students various card decks and games have been devised. The known prior art vocabulary building card decks have application only to games specifically devised for these decks. Examples of these known card decks and games are disclosed in Collins U.S. Pat. No. 2,783,998 and Alam U.S. Pat. No. 3,678,602. Such decks, however, cannot be used to play conventional card games such as rummy, poker, casino, bridge, solitaire and the like. Since these well-known games have maintained the interest of people of all ages for generations, it would be desirable to devise a card deck comprising vocabulary building playing cards adaptable for use in such well-known games.

SUMMARY OF THE INVENTION

Accordingly, it is a primary object of the present invention to provide a deck of vocabulary building playing cards that can be used for playing conventional card games.

It is another object of this invention to provide a deck having vocabulary building playing cards including a vocabulary word and an objective test of the definition on the cards, the correct definition of the vocabulary word identifying the specific card of a conventional deck of playing cards.

It is a further object of the invention to provide vocabulary building playing cards having conventional suit designations and value denominations, and wherein each card has a vocabulary word and a plurality of definition words including different associated value denominations, one of which is the correct definition of the vocabulary word and value denomination of the card.

The above objects as well as others, which will subsequently become clear, are achieved by providing a deck of cards similar to a coventional pack of playing cards and adaptable to any game calling for such, but in order to determine the value denomination of a card an objective vocabulary test must first be solved. Selection of the correct definition of the vocabulary word identifies the value denomination of the card. The conventional suit designation is preferably imprinted on each together with a vocabulary word and a plurality of definition words, one of which is correct. Adjacent each definition word is indicia defining a different value denomination. The true value denomination of the card corresponds to the correct definition of the vocabulary word thereon. When all the correct definitions are selected, play of any conventional game can proceed. Means such as clips may be applied to the cards to mark the correct definition during play.

BRIEF DESCRIPTION OF THE DRAWINGS

Other objects and advantages of the invention will best be understood upon reading the following detailed description of the invention together with the accompanying drawings, in which:

FIG. 1 illustrates a perspective view of a deck of cards constructed in accordance with the present invention, with the design side of the cards on top; and FIGS. 2–5 illustrate the obverse side of one card from each of the four conventional suits of the deck illustrating typical vocabulary words and definition words of a given level of difficulty.

DETAILED DESCRIPTION OF THE INVENTION

Referring now to the drawing FIG. 1 illustrates a deck of cards 10 having any convenient logo 12 on the design or reverse side thereof. The deck is preferably conventionally comprised of 52 cards having an equal number of the four conventional suits of spades, hearts, diamonds and clubs. It should, however, be understood that the principles of the invention can be applied to other conventional playing card decks such as the 48 card pinochle deck without departing from the spirit of the invention. However, for sake of illustration the invention is described in conjunction with a conventional 52 card deck comprising four suits having 13 cards each.

Preferably the deck comprises forty-eight vocabulary cards and four free cards, but all or any number of the cards may be vocabulary cards with the remaining cards, if any, constituting free cards. Each vocabulary card includes a vocabulary word displayed thereon followed by preferably three objective test or multiple choice words, only one of which is the correct definition. Of course any number of incorrectly defined multiple choice words may accompany the correct definition, with three being preferred. Indicia representing one of the twelve possible value denominations of the vocabulary cards is listed adjacent each of the definition words. The value denomination of the card is that corresponding to the value denomination adjacent the correct definition of the vocabulary word. For example, FIGS. 2–5 each illustrate one vocabulary card from the suits of spades, hearts, diamonds and clubs, respectively. In FIG. 2 the card 112 is of the spade 114 suit having the vocabulary word "ANTITHESIS" 116 in the upper left-hand corner. Below this vocabulary word are three definitions: "the opposite," "unevenly," and "deep dislike," represented generally as 118. Adjacent each definition is a respective value denomination "7," "8," and "9," represented generally as 120. As the correct definition of ANTITHESIS is the opposite, the card 112 illustrated in FIG. 1 is the 7 of spades, because the value denomination 7 is adjacent the definition the opposite. Similarly, the card 212 is a heart 214 having the vocabulary word "EGRESS" 216 thereon. The definition words 218 are "exit," "entrance," and "return," having value denomination 4, 5, and 6 respectively adjacent thereto, which value denominations are represented generally as 220. This card is thus the 4 of hearts since the correct definition of the vocabulary word EGRESS is exit. In a similar manner the card 312 illustrated in FIG. 4 is the 2 of diamonds, since the vocabulary word "GHOUL" 316 means "grave robber," and the value denomination of this definition word is 2. Again, the card 412 in FIG. 5 is the jack (J)

of clubs since the vocabulary word "AUGURY" 416 means "prophecy."

Thus, it should be understood that each vocabulary card requires the correct definition of the vocabulary word thereon to be selected prior to identification of the value denomination of the card. When all the vocabulary words are correctly defined the cards may be used as any other conventional deck of playing cards with each player dealt a hand depending upon the particular game of cards. The free cards have no vocabulary word thereon, and thus no objective test is required to determine their value denomination. In the preferred deck there are four free cards each constituting a king (K) in one of the four suits. However, it should be understood that the number of free cards, if any, is a matter of choice.

The decks may be packaged in a game set comprising a plurality of such decks having varying levels of difficulty. Included with each deck may be a reference card compiling a list of the vocabulary words in the deck followed by their correct definitions so as to check the selected answers. The decks also include transparent celluloid clips illustrated at 130 in FIG. 2 for selectively marking the correct definition or value denomination of each vocabulary card after it has been determined. The clips may be mounted on the edge of each card thereby marking the value denomination of the cards when they are used to play conventional card games.

Numerous alternatives of the structure herein disclosed will suggest themselves to those skilled in the art. For example, the value denomination could be imprinted on the card instead of the suit in which event correct definition of the vocabulary word identifies the suit. However, it is to be understood that the present disclosure relates to a preferred embodiment of the invention which is for purposes of illustration only and not to be construed as a limitation of the inventon. All such modifications which do not depart from the spirit of the invention are intended to be included within the scope of the appended claims.

Having thus set forth the nature of the invention, what is claimed is:

1. Vocabulary building playing cards comprising a deck having a multiplicity of cards, each card displaying symbolic indicia defining a suit designation, there being 4 suits in said deck, each suit having a prescribed number of different value denominaions, the value denominations of each suit being the same as each other suit, at least some of said cards being vocabulary cards having a vocabulary word thereon, each of said vocabulary cards displaying indicia comprising a correct definition and a plurality of incorrect definitions of the respective vocabulary word, indicia defining a different value denomination on each vocabulary card adjacent each correct and each incorrect definition, the value denomination of each vocabulary card being that corresponding to the correct definition of the vocabulary word.

2. Vocabulary bulding playing cards as recited in claim 1 wherein each suit comprises thirteen different value denomination cards.

3. Vocabulary building playing cards as recited in claim 1 wherein each vocabulary card has a different vocabulary word thereon.

4. Vocabulary building playing cards as recited in claim 1 wherein at least forty-eight cards are vocabulary cards.

5. Vocabulary building playing cards as recited in claim 1 including means for selectively marking the correct value denomination of each vocabulary card.

6. Vocabulary building playing cards as recited in claim 5 wherein said means comprise a transparent clip detachably mounted to an edge of said cards.

* * * * *